United States Patent [19]

Hendricks et al.

[11] 4,268,266

[45] May 19, 1981

[54] PROCESS FOR DYEING AND PRINTING CELLULOSE FIBRES WITH REACTIVE DYESTUFFS

[75] Inventors: Udo-Winfried Hendricks; Dietrich Hildebrand, both of Odenthal; Robert Kuth, Cologne, all of Fed. Rep. of Germany

[73] Assignee: Bayer Aktiengesellschaft, Leverkusen, Fed. Rep. of Germany

[21] Appl. No.: 69,691

[22] Filed: Aug. 27, 1979

[30] Foreign Application Priority Data

Sep. 1, 1978 [DE] Fed. Rep. of Germany ..... 2838274

[51] Int. Cl.[3] ..... D06P 3/66; D06P 1/613; D06P 1/607; D06P 1/38

[52] U.S. Cl. ..... 8/543; 8/188; 8/189; 8/544; 8/546; 8/549; 8/552; 8/553; 8/564; 8/565; 8/566; 8/570; 8/573; 8/576; 8/609; 8/918

[58] Field of Search ..... 8/84, 54.2, 188, 189, 8/93, 79, 163, 171, 173, 1 D, 1 E, 546, 543, 549, 552, 553, 609, 564, 565, 570, 566, 573, 576

[56] References Cited

U.S. PATENT DOCUMENTS 3,791,787 2/1974 Yamada et al. ..... 8/54.2
3,923,457 12/1975 Ong et al. ..... 8/93
3,980,426 9/1976 Feess et al. ..... 8/173
4,115,053 9/1978 Aeschlimann ..... 8/163
4,149,849 4/1979 Koch et al. ..... 8/54.2

FOREIGN PATENT DOCUMENTS 1120761 7/1968 United Kingdom .
1169254 11/1969 United Kingdom .
1530104 10/1978 United Kingdom .

OTHER PUBLICATIONS

Translation Japan Kokai 78-143784, Publ. 12-14-78, Nose et al., "Process of Dyeing Active Hydrogen Containing Fibers".

Derwent 39901U/28 "Dyeing Silk Yarn or Fabric Followed by Treatment with Epoxide to Increase Dye Fastness", JA73222874-R, Jul. 9, 1973.

*Primary Examiner*—Joseph L. Schofer
*Assistant Examiner*—Herbert J. Lilling
*Attorney, Agent, or Firm*—Sprung, Felfe, Horn, Lynch & Kramer

[57] ABSTRACT

Padding liquors or printing pastes which contain at least one compound which is free from ionic groups and possesses one or more glycidyl radicals are used for dyeing and printing cellulose fibres or textile materials containing cellulose fibres with water-soluble reactive dyestuffs in the absence of alkalis or alkaline compounds.

2 Claims, No Drawings

PROCESS FOR DYEING AND PRINTING CELLULOSE FIBRES WITH REACTIVE DYESTUFFS

The invention relates to a process for dyeing and printing cellulose fibres or fibre blends containing cellulose fibres with water-soluble reactive dyestuffs in the absence of alkalis or alkaline compounds. The process is characterised in that padding liquors or printing pastes are used which contain at least one compound which is free from ionic groups and possesses one or more glycidyl radicals, and which have a pH value of between 7.5 and 2.7, especially between 7.0 and 3.5. The compounds possessing glycidyl groups are preferably water-soluble compounds wich are liquid at room temperature and have a boiling point of not less than 220° C.

Particular mention should be made of compounds containing glycidyl groups, of the formula $$Z\,[Q]_p \qquad (I)$$

wherein

Q denotes a radical of the formula

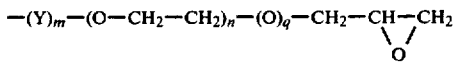

Z denotes a monovalent to tetravalent aliphatic hydrocarbon radical which can be interrupted by S-atoms, a cycloaliphatic hydrocarbon radical, a saturated heterocyclic radical or the groups PO,

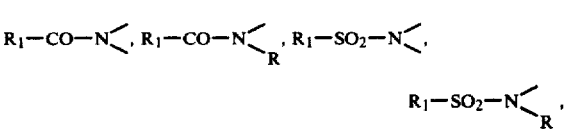

$R_1$—NH—CO— or —OC—NH—A—NH—CO—,

R denotes hydrogen or alkyl, $R_1$ denotes alkyl, cycloalkyl, aryl or aralkyl,

Y denotes a radical of the formula —CO—$CH_2$—$CH_2$—, —$SO_2$—$CH_2$—$CH_2$— or —$CH_2$—$CH_2$—, A denotes alkylene or arylene, m denotes 0 or 1, n denotes 0–10, q denotes 0 or 1 and p denotes 1–4.

q only represents zero if m and n are zero and the glycidyl radical is bonded to a hetero-atom of Z.

If p represents 2–4, the substituents Q are bonded to different atoms of Z.

The bridge member Y is preferably bonded to a nitrogen atom of Z.

The aliphatic and cycloaliphatic hydrocarbon radicals are in particular optionally branched radicals with up to 8 C atoms.

Preferred aliphatic radicals Z and preferred alkyl radicals R and $R_1$ are those with 1–5 carbon atoms.

Preferred cycloaliphatic radicals Z and cycloalkyl radicals $R_1$ are the cyclopentyl and cyclohexyl radical.

Aryl and aralkyl in particular represent phenyl and benzyl respectively.

A for example represents a $C_2$–$C_6$-alkylene or a phenylene radical.

Examples of heterocyclic radicals Z are the 1,3,5-hexahydrotriazine radical or radicals of the formula

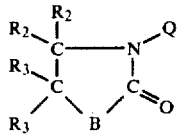

(II)

wherein $R_2$ represents hydrogen or the $R_2$'s conjointly represent oxygen, $R_3$ represents hydrogen or methyl and B represents

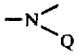

or —$CH_2$—, or the group

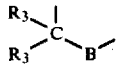

represents an o-phenylene radical.

Amongst the compounds of the formula I, those of the formula $$Z_1[(-O-CH_2-CH_2)_n-O-CH_2-\underset{\underset{O}{\backslash\,/}}{CH-CH_2}]_p \qquad (III)$$

wherein $Z_1$ denotes a monovalent to tetravalent aliphatic hydrocarbon radical with 1–5 carbon atoms, and n and p have the abovementioned meaning, those of the formula $$O{=}P[(-O-CH_2-CH_2)_n-O-CH_2-\underset{\underset{O}{\backslash\,/}}{CH-CH_2}]_3 \qquad (IV)$$

wherein n has the abovementioned meaning, and those of the formula $$Z_2[\{Y_1(O-CH_2-CH_2)_n-O-\}_{0\ or\ 1}-CH_2-\underset{\underset{O}{\backslash\,/}}{CH-CH_2}]_{p1} \qquad (V)$$

wherein $Z_2$ denotes the 1,3,5-hexahydrotriazine radical or a radical of the formula II, $Y_1$ denotes —CO—$CH_2$—$CH_2$— or —$SO_2$—$CH_2$—$CH_2$— and $p_1$ denotes 1–3, n has the abovementioned meaning and the radical in square brackets is bonded to a nitrogen atom of $Z_2$ are preferred.

Examples of the compounds I are:

$$CH_3-O-(CH_2-CH_2-O)_2-CH_2-\underset{\underset{O}{\backslash\,/}}{CH-CH_2}$$

$$C_2H_5-O-(CH_2-CH_2-O)_2-CH_2-\underset{\underset{O}{\backslash\,/}}{CH-CH_2}$$

-continued

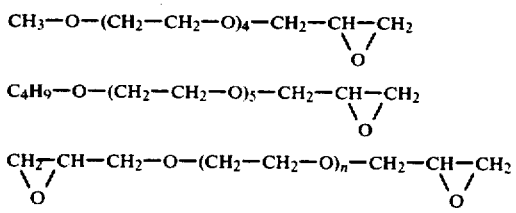

n = 0-8, especially 1-6

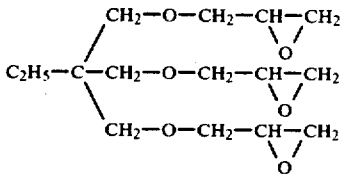

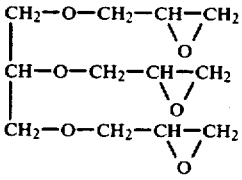

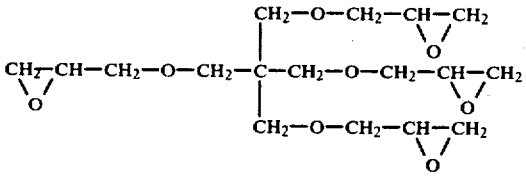

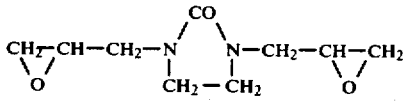

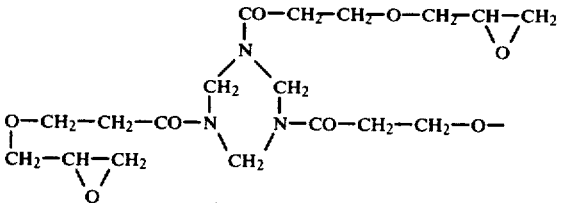

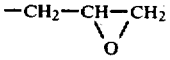

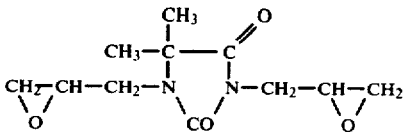

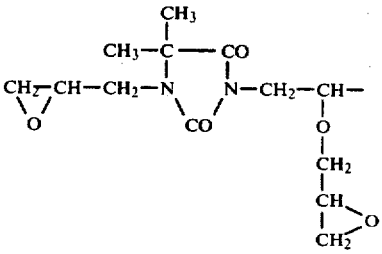

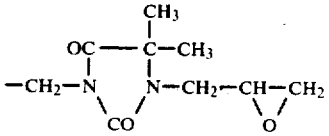

-continued

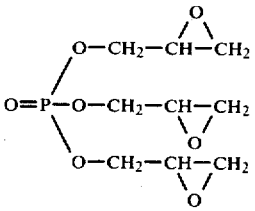

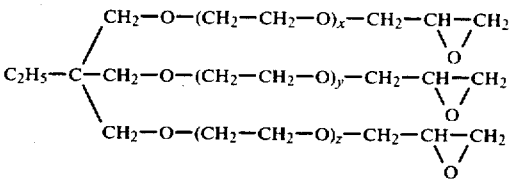

x,y,z = 1-10
x + y + z = 25

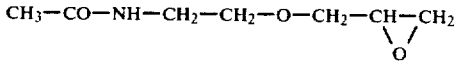

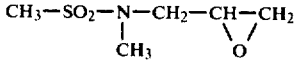

and

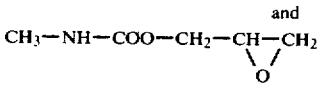

The water-soluble reactive dyestuffs which can be employed in the process according to the invention are dyestuffs which possess at least one sulpho group and are from the category of the azo, anthraquinone, phthalocyanine and oxazine series. The dyestuffs which are suitable for the process according to the invention must have a reactivity which corresponds to a hydrolysis constant of at least 0.0015 $min^{-1}$ at pH 10.0 and 60° C. (compare E. Siegel, K.-H. Schündehütte and D. Hildebrand in Ventakaraman, Synthetic Dyes, vol. VI, Academic Press Inc. New York 1972, page 352). Suitable dyestuffs are in particular those containing at least one halogenotriazinyl or halogenopyrimidyl group. Reactive dyestuffs which contain at least one 2,4-difluoro-5-chloropyrimid-6-yl group, a monofluoro-s-triazinyl group or a monofluoro-monochloro-pyrimidyl group have proved particularly suitable. These preferentially usable reactive dyestuffs are described, for example, in British Patent Specifications Nos. 1,120,761 and 1,169,254, Belgian Patent Specifications Nos. 613,586, 714,937, 716,013 and 716,014 and German Offenlegungsschriften (German Published Specifications) Nos. 1,644,208, 2,603,670 and 2,607,028.

Dyeing according to the process of the invention is effected by impregnating the textile materials, containing cellulose fibres, with the aqueous padding liquors in the usual manner, squeezing off to a weight increase of 40 to 100% and subjecting the material, if appropriate after brief intermediate drying, to a heat treatment at 190°-230° C. for about 30 to 90 seconds. For printing, the printing pastes are prepared using the conventional thickeners for reactive dyestuffs, such as alginates. The dyestuffs are fixed on the printed textile materials either by a dry heat treatment at 190°-230° C. for one to two minutes, or by high temperature steaming at 170°-190° C. for 2-15 minutes. Suitable cellulose-containing textile materials are those of natural and regenerated cellulose and their blends with poly(ethylene glycol terephthalate).

The amounts of epoxide compound I to be employed according to the process of the invention are between 25 and 100 g/l; amounts of between 25 and 50 g/l have proved advantageous. For dyeing or printing mixed textiles of cellulose fibres/poly(ethylene glycol terephthalate), the padding liquor or printing paste can also contain, in addition to the reactive dyestuff to be used in accordance with the claims, a commercial disperse dyestuff which, on heat-treating the textile material at 170°-230° C. as required by the process, gives a fast dyeing of the poly(ethylene terephthalate) constituent of the fibre mixture, providing that the disperse dyestuff does not contain a hetero-atom capable of alkylation and is thus unable to undergo an undesired side-reaction with the reactive dyestuff or the epoxide to be used in accordance with the claims. The padding liquor or printing paste can in addition contain polyethylene glycol ethers and/or polypropylene glycol ethers in amounts of 0-100 parts per 1,000 parts of padding liquor or printing paste.

German Offenlegungsschrift (German Published Specification) No. 2,238,552 describes a process for dyeing cellulose textiles with reactive dyestuffs at temperatures above 150° C., in which the reaction accelerators used are cyclic alkylene esters of carbonic acid instead of the conventionally used alkaline acid-binding agents such as sodium bicarbonate, sodium carbonate, borax, sodium formate, disodium phosphate and others. The use of these esters is intended to avoid the disadvantages associated with the use of the acid-binding agents, such as yellowing of the cellulose and degradation of conjointly used disperse dyestuffs which are labile under alkaline conditions. Using the carbonic acid esters, dyeing by the impregnation process gives dyeing yields, from reactive dyestuffs, which approximately correspond to those which are achieved with the conventional alkaline acid-binding agents, that is to say they do not offer any increase in the dyeing yields of the known processes, even though these undoubtedly require improvement. A further disadvantage of the process described in German Offenlegungsschrift (German Published Specification) No. 2,238,552 is that relatively large amounts of cyclic carbonic acid esters must be employed, since, using smaller amounts, the fixing yield decreases markedly and the dyeing is no longer reliably reproducible.

It has now been found, surprisingly, that with the epoxide compounds to be used according to the invention, not only can the fixing yield of reactive dyestuffs on cellulose fibres in the absence of alkalis be substantially improved, but also reliable and reproducible dyeing is ensured even when small amounts are employed.

The parts referred to in the examples which follow are parts by weight, unless stated otherwise. The combinations of the dyestuffs I to IX used in the examples are shown in the table which follows the examples.

EXAMPLE 1

A cotton fabric is padded with a padding liquor which contains 20 parts of the reactive dyestuff I and 25 parts of the compound of the formula

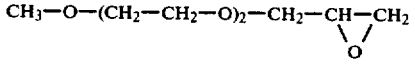

in 955 parts of water. The pH value of the padding liquor is 5.6. The fabric is squeezed off to a weight increase of 70%, dried for one minute at 130° C. and then subjected to a hot air treatment at 220° C. for one minute. The fabric is then rinsed cold for 5 minutes and warm for 5 minutes and is subsequently treated for 10 minutes with boiling water, rinsed warm for 5 minutes and dried. A deep red dyeing with excellent fastness characteristics is obtained.

If instead of the compound of the formula

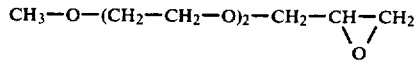

the same number of parts of the compound of the formula

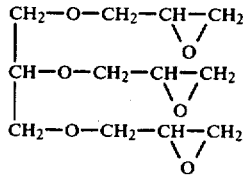

is used, a similar red dyeing is obtained.

A similar red dyeing is obtained if instead of the compound of the formula

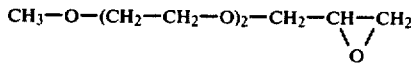

the same number of parts of the compound of the formula

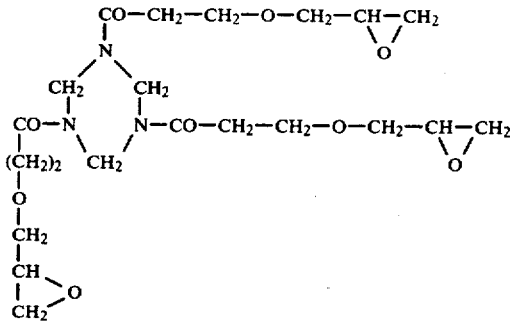

is used.

EXAMPLE 2

A mixed fabric consisting of 67 parts of poly(ethylene glycol terephthalate) and 33 parts of cotton is padded with a padding liquor which contains 25 parts of the dyestuff II and 50 parts of the dyestuff VII as well as 25 parts of the compound of the formula

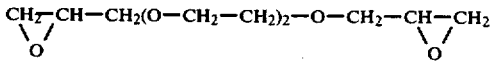

in 900 parts of water. The pH value of the padding liquor is 5.0. The fabric is squeezed off to a weight increase of 70% and then subjected to a hot air treatment at 220° C. for one minute. Thereafter the fabric is rinsed cold for five minutes and warm for five minutes and is subsequently soaped at the boil for 10 minutes with a wash solution which contains 5 parts of a customary detergent, for example a paraffinsulphonate, per 1,000 parts, rinsed warm for five minutes and dried. A deep blue dyeing having good fastness characteristics is obtained.

If instead of the compound of the formula

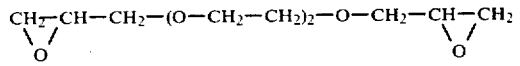

the same number of parts of the compound of the formula

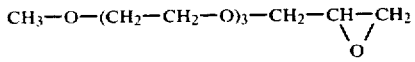

is used, a dyeing of equal strength is obtained.

EXAMPLE 3

A cotton fabric is printed with an aqueous printing paste which contains 60 parts of the reactive dyestuff III, 450 parts of a 4% strength aqueous alginate thickener, 10 parts of the compound of the formula

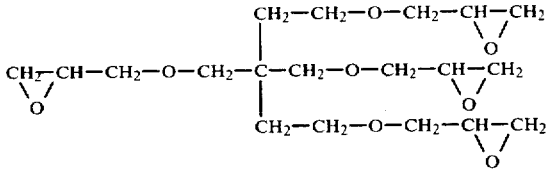

and 50 parts of polyethylene glycol in 1,000 parts, dried for 1 minute at 130° C. and then subjected to a hot air treatment at 220° C. for one minute. After thorough rinsing with cold and warm water, the fabric is soaped at the boil for 20 minutes with a solution which contains 1 part of a commercial paraffinsulphonate and 0.5 part of sodium carbonate in 1,000 parts, and is rinsed with warm water and dried. A deep red print is obtained, with excellent yield from the dyestuff.

EXAMPLE 4

A mixed fabric consisting of 67 parts of poly(ethylene glycol terephthalate) and 33 parts of cotton is printed with an aqueous printing paste which contains 15 parts of the reactive dyestuff IV, 30 parts of the disperse dyestuff VI, 550 parts of a 4% strength aqueous alginate thickener and 50 parts of the compound of the formula

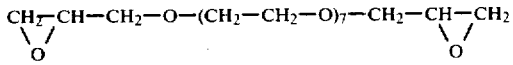

in 1,000 parts. The fabric is dried for two minutes at 80° C. and then treated with hot air at 220° C. for 1 minute. After thorough rinsing with cold and warm water, the fabric is then soaped at the boil for 20 minutes with a solution which contains 1 part of a commercial paraffinsulphonate and 0.5 part of sodium carbonate in 1,000 parts, rinsed with clear water and dried. A clear red print is obtained, with excellent yield from the dyestuff.

EXAMPLE 5

A mixed fabric consisting of 67 parts of poly(ethylene glycol terephthalate) and 33 parts of cotton is padded with a padding liquor which contains 20 parts of the dyestuff V, 30 parts of the dyestuff VIII, 50 parts of the compound of the formula

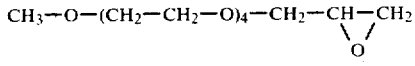

and 50 parts of polyethylene glycol in 850 parts of water, dried for 1 minute at 130° C. and then subjected to a hot air treatment at 200° C. for one minute. After thorough rinsing with cold and warm water the fabric is soaped at the boil for 20 minutes with a solution which contains 1 part of a commercial paraffinsulphonate and 0.5 part of sodium carbonate in 1,000 parts, rinsed with warm water and dried. A clear yellow dyeing is obtained, with excellent yield from the dyestuff.

EXAMPLE 6

A mixed fabric consisting of 50 parts of viscose staple and 50 parts of poly(ethylene glycol terephthalate) is printed with an aqueous printing paste which contains 30 parts of the reactive dyestuff of the formula IX, 30 parts of the disperse dyestuff VI and 40 parts of the compound of the formula

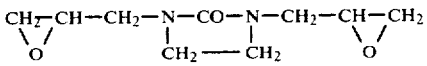

in 1,000 parts of water. The fabric is dried for 2 minutes at 80° C. and then steamed for 15 minutes with superheated steam at 180° C. After thorough rinsing with cold and warm water, the fabric is soaped at the boil for 20 minutes with a solution which contains 1 part of a commercial paraffinsulphonate and 0.5 part of sodium carbonate in 1,000 parts, rinsed with clear water and dried. A deep red print is obtained, with excellent yield from the dyestuff.

I

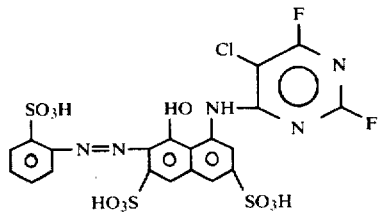

II

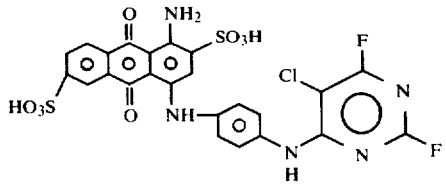

III

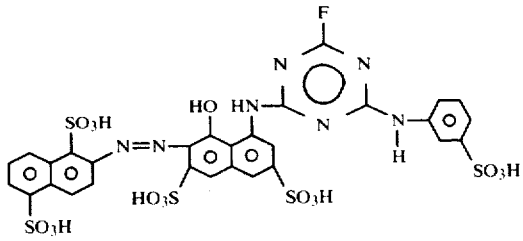

-continued

IV

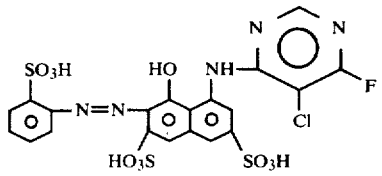

V

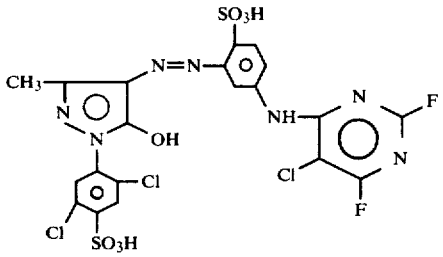

VI

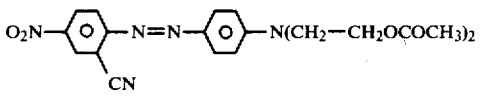

VII

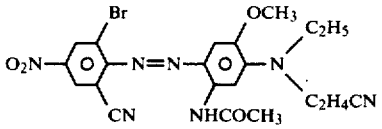

VIII

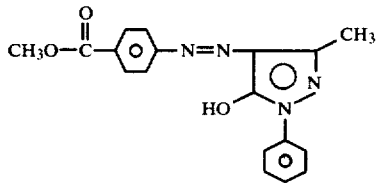

-continued

IX

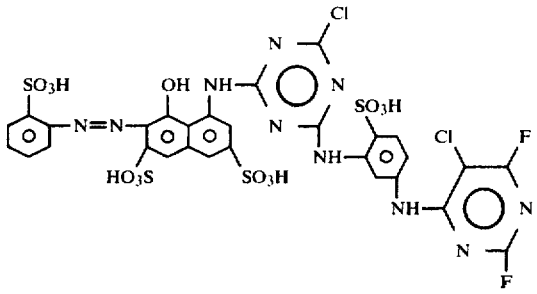

We claim:

1. In the dyeing and printing of fibres and textile materials containing cellulose wherein the fibres or textile materials are contacted with a padding liquor or printing paste containing a water-soluble reactive dyestuff in the absence of alkali or alkaline compounds, the improvement which comprises incorporating in the padding liquor or printing paste at least one compound of the formula

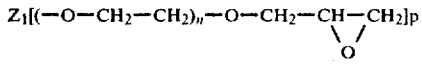

wherein $Z_1$ is a monovalent to tetravalent aliphatic hydrocarbon radical with 1-5 carbon atoms, n is 0-10, and p is 1-4.

2. A process according to claim 1, wherein the incorporated compound is of the formula

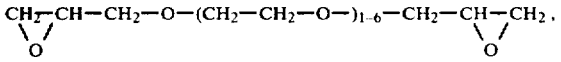

* * * * *